US011806599B2

(12) United States Patent
Pegnatori

(10) Patent No.: US 11,806,599 B2
(45) Date of Patent: Nov. 7, 2023

(54) SAFETY SCREEN ASSEMBLY

(71) Applicant: Monsta Athletics, LLC, Claimesa, CA (US)

(72) Inventor: Carl Pegnatori, Calimesa, CA (US)

(73) Assignee: Monsta Athletics, LLC, Calimesa, CA (US)

( * ) Notice: Subject to any disclaimer, the term of this patent is extended or adjusted under 35 U.S.C. 154(b) by 247 days.

(21) Appl. No.: 17/229,725

(22) Filed: Apr. 13, 2021

(65) Prior Publication Data

US 2022/0323846 A1 Oct. 13, 2022

(51) Int. Cl.

| | |
|---|---|
| ***A63B 67/00*** | (2006.01) |
| ***A63B 71/00*** | (2006.01) |
| ***A63B 71/02*** | (2006.01) |
| ***A45C 9/00*** | (2006.01) |
| *A45C 5/14* | (2006.01) |
| *A63B 69/00* | (2006.01) |

(52) U.S. Cl.

CPC ..... *A63B 71/022* (2013.01); *A45C 9/00* (2013.01); *A45C 5/14* (2013.01); *A63B 2069/0006* (2013.01); *A63B 2071/025* (2013.01)

(58) Field of Classification Search

CPC ..... A63B 71/022

USPC ..... 473/421

See application file for complete search history.

(56) References Cited

U.S. PATENT DOCUMENTS

| | | | | |
|---|---|---|---|---|
| 5,887,879 | A * | 3/1999 | Chumley | B62B 1/208 280/42 |
| 6,217,043 | B1 * | 4/2001 | Chumley | B62B 1/208 280/655 |
| 7,255,658 | B1 * | 8/2007 | VanKuiken | A63B 69/0075 473/456 |
| 8,651,981 | B2 * | 2/2014 | Morrow | A63B 69/0002 473/197 |
| 9,604,112 | B2 * | 3/2017 | Gilman | A63B 69/00 473/477 |
| 9,821,206 | B2 * | 11/2017 | Mosher | A63B 71/022 473/451 |
| 10,500,460 | B2 * | 12/2019 | Ali | A63B 63/00 473/476 |
| 2004/0188963 | A1 * | 9/2004 | Gant | B62B 1/125 280/47.24 |
| 2013/0168334 | A1 * | 7/2013 | Garrabrants | A63B 69/0002 211/13.1 |
| 2015/0353111 | A1 * | 12/2015 | Brown | B62B 1/042 280/47.18 |

FOREIGN PATENT DOCUMENTS

| | | | | |
|---|---|---|---|---|
| WO | WO-2005044653 | A1 * | 5/2005 | B62B 1/12 |

* cited by examiner

*Primary Examiner* — Mitra Aryanpour

(74) *Attorney, Agent, or Firm* — David B. Abel

(57) ABSTRACT

A safety screen assembly that couples to or is a component of an equipment bag for sports training is disclosed. The safety screen assembly is configured to be coupled with an equipment bag and function as a rolling carrier in a first configuration, and convert to a full-sized safety screen in a second configuration utilizing the equipment bag as a ballast and support. In a preferred embodiment the safety screen is designed to protect a pitcher from batted balls during batting practice.

6 Claims, 8 Drawing Sheets

SAFETY SCREEN ASSEMBLY

BACKGROUND OF THE INVENTION

In a variety of sports, at least two participants are required during training exercises where one of the participants is in a vulnerable position opposite another athlete. For example, in batting exercises for baseball, softball or cricket, a pitcher throws a ball to a hitter that may be less than sixty feet away. The hitter may hit a ball back toward the pitcher at speeds in excess of ninety miles per hour. The short separation, coupled with the speed of the batted ball, places the pitcher at risk of severe injury. Various configurations of shields or nets have been utilized that may be placed between the pitcher and the batter during batting exercises. Professional facilities at which games are played may provide the safety net for use in batting exercises prior to a game. However, players often practice in small fields or open spaces that do not provide safety nets. For their own protection, players and coaches may need to bring and set up their own safety net systems. One such system is disclosed in U.S. Pat. No. 9,821,206, which discloses a rolling shell case that contains the components to erect a safety net on a field.

In some competitive league environments, facilities or the governing body limit the amount, size and or number of equipment bags a player may bring to the field. Ball players often have equipment bags capable of containing several bats, balls, gloves and other protective gear, precluding them from using the standalone system of the previously noted U.S. Pat. No. 9,821,206. The present invention provides an easily erected safety screen assembly that may incorporate or be attached to an equipment bag, and which utilizes the equipment bag as ballast and support of the safety screen.

SUMMARY OF THE INVENTION

According to various embodiments of the present invention, a player safety screen assembly is incorporated onto or made to accommodate an equipment bag. The safety screen assembly may include wheels, or it may be attached to a wheeled equipment bag. The safety screen assembly preferably consolidates to a size roughly 1.5 to 2 feet wide and 3 to 4 feet long, generally matching the size of the base of a standard equipment bag. On location, the safety screen assembly rotates on hinges through 80 to 90 degrees and locks in an upright position generally perpendicular to the base of the equipment bag. The safety screen assembly preferably includes an extendable main frame assembly in which tubular right and left side elements telescope to length of at least 5 feet, and top and bottom tubular elements that may extend to a width of 3 to 6 feet. Optionally, the safety screen assembly may include one or two attached or attachable wings that can extend outward from an upper or lower portion of the main frame assembly to extend the protection for either an overhand or underhand pitcher. The safety screen assembly further includes netting shaped as a pocket sized to fit over the erected main frame, or the netting may otherwise be removably attached to the main frame and stored in a pocket of the equipment bag during transport. Separate netting may similarly be provided for the optional wings.

DETAILED DESCRIPTION OF THE INVENTION

Figure 1:
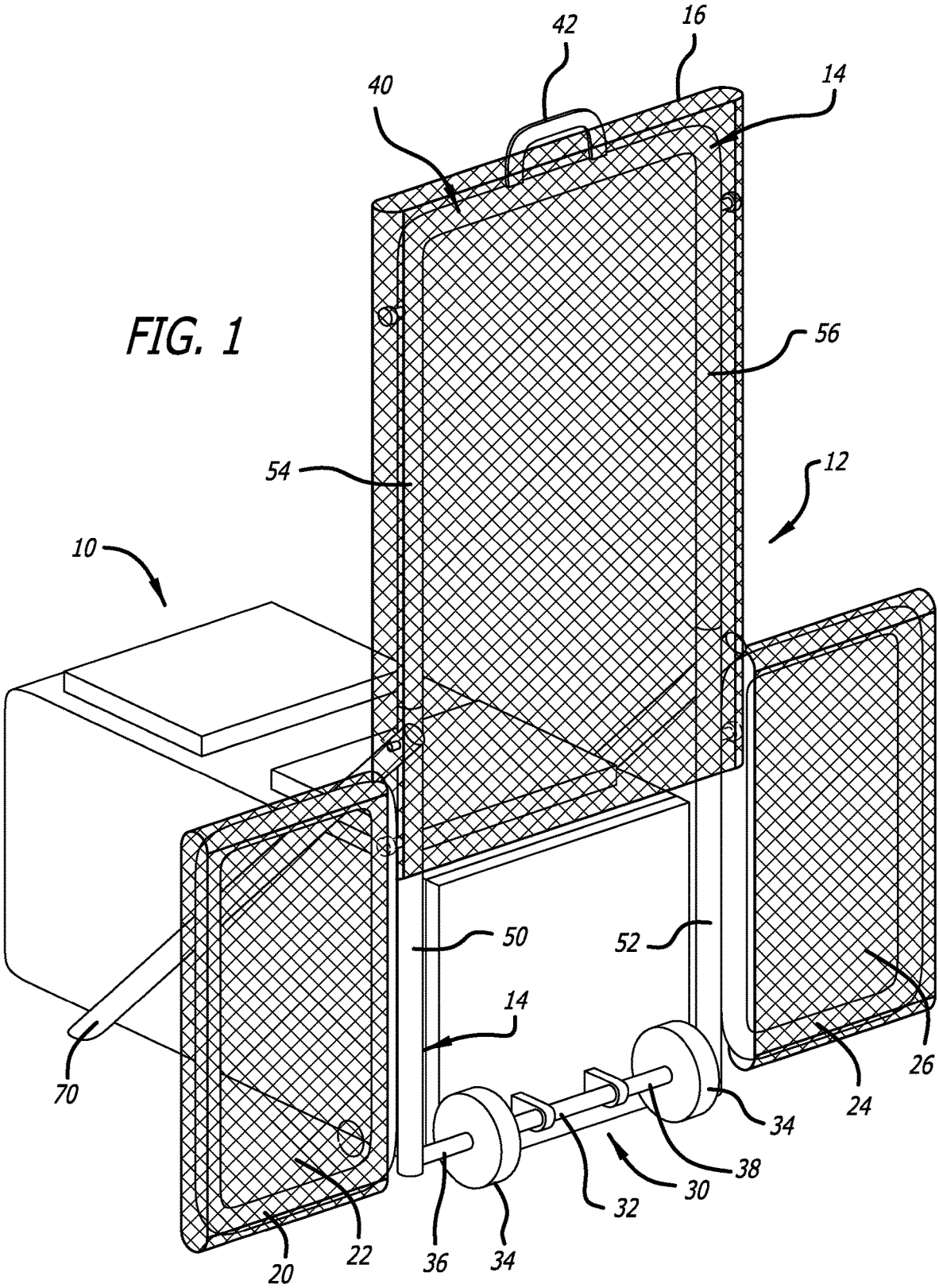
FIG. 1 depicts a perspective view of the safety screen assembly and equipment bag of the present invention.
Figure 2:
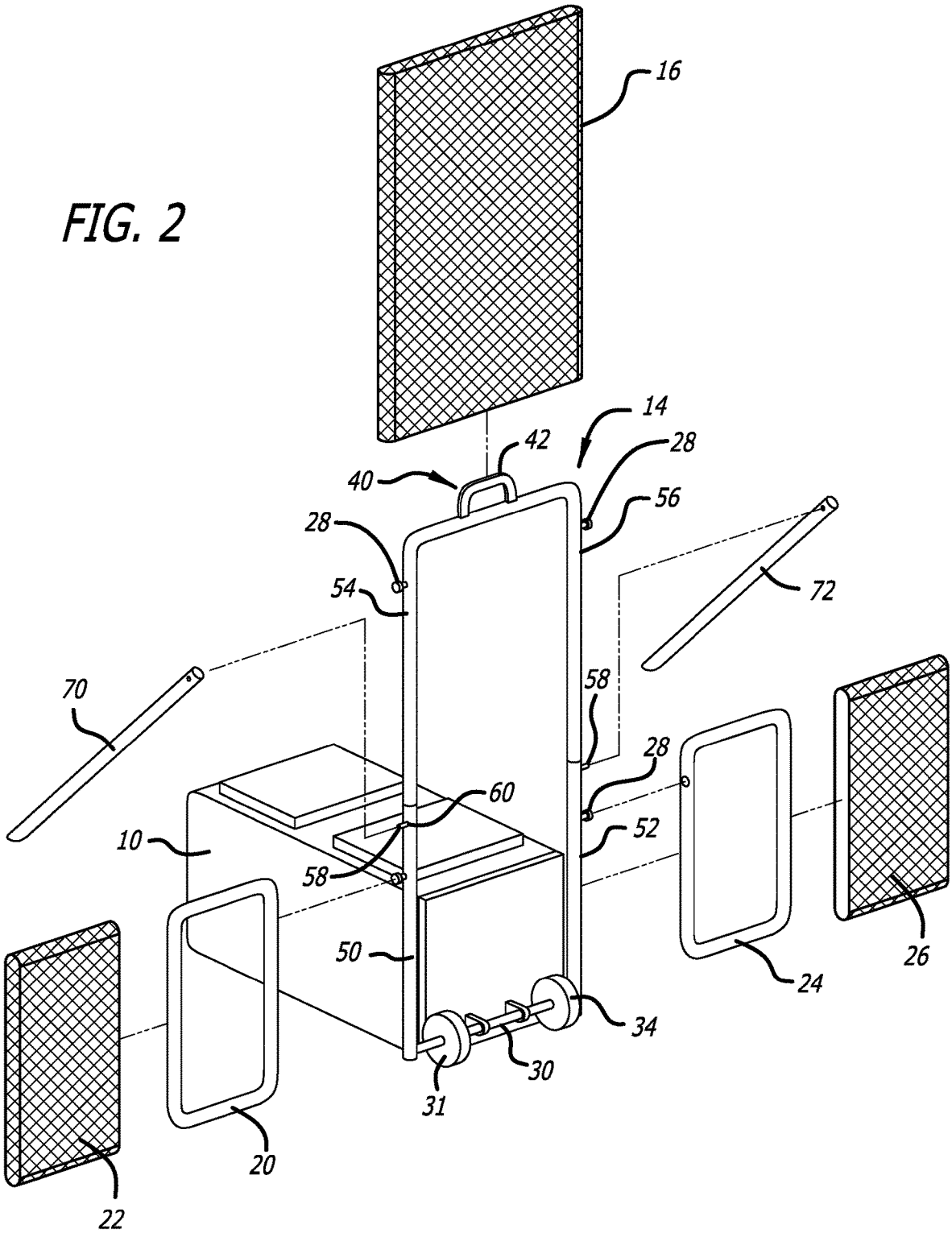
FIG. 2 depicts a perspective component view of the safety screen assembly and equipment bag of the present invention.
Figure 3:
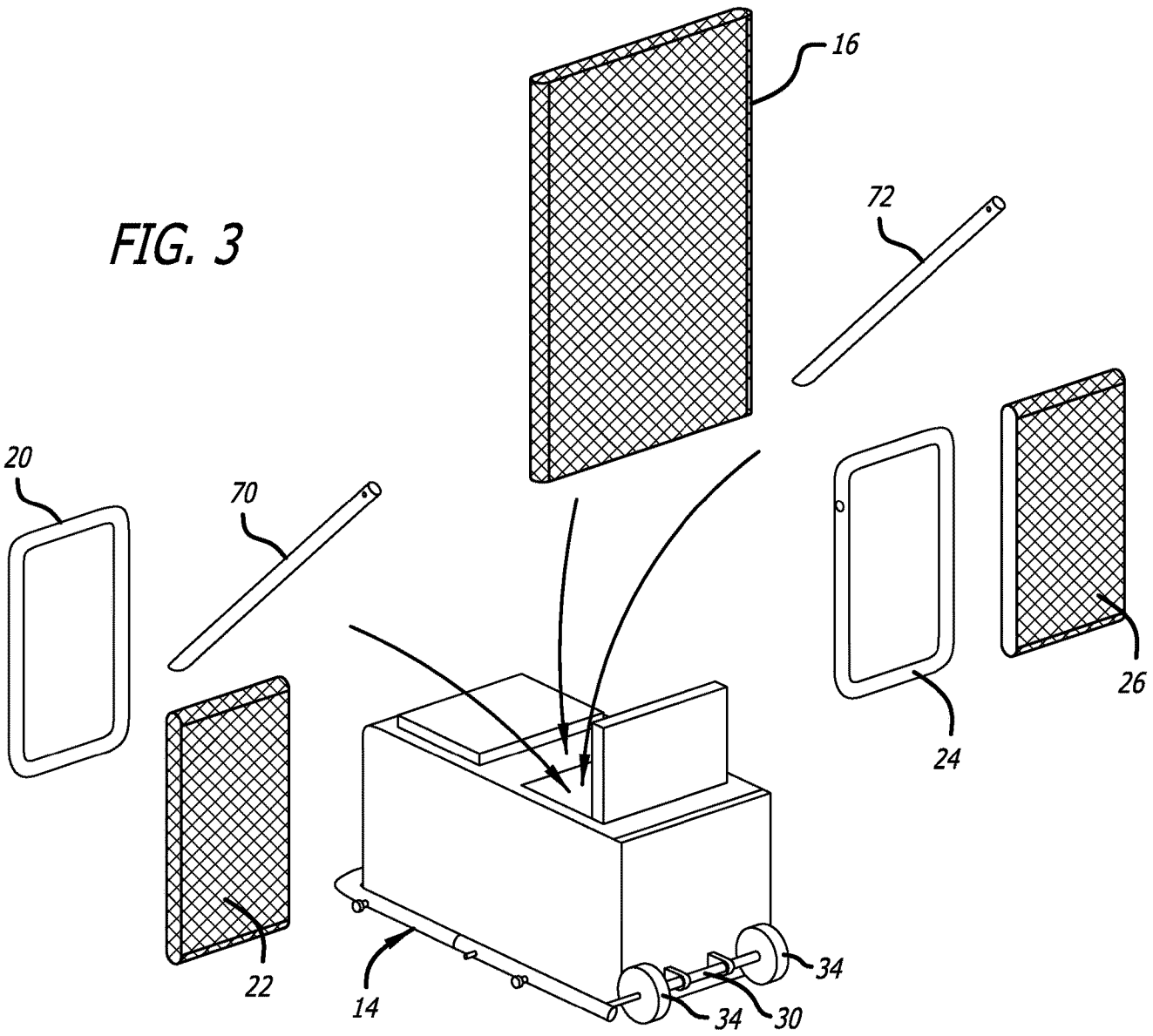
FIG. 3 depicts another perspective component view of the safety screen assembly and equipment bag of the present invention.

FIG. 1 depicts a perspective view of an equipment bag 10 and a safety screen assembly 12. FIGS. 2 and 3 depict perspective component views of the safety screen assembly 12 of the present invention. As discussed herein, the safety screen assembly 12 is preferably formed integrally with the equipment bag 10. However, in alternative embodiments, the safety screen assembly 12 may be configured to be mounted onto an equipment bag 10.

The safety screen assembly 12 includes a main frame 14 having a main screen 16. The safety screen assembly 12 may optionally include a right wing frame 20 and wing screen 22 and a left wing frame 24 and wing screen 26. Each of the screens 16, 22 and 26 may be formed as two layers attached along at least a portion of three sides to generally form a pocket shape that may easily slide over the respective frame component. Optionally, the screens may be a single sheet with reinforced edges and attachment elements that allow the screens to be easily attached to the frames. The screens are preferably formed from a high density polyethylene, high density polypropylene or nylon material twisted and knotted to define one-half to two inch openings and may include a reinforced edging or border. The right and left wing frames preferably include slotted holes allowing the wing frames 20, 24 to be removably mounted on buttons 28 projecting from upper and lower locations on the main frame 14.

Figure 5:
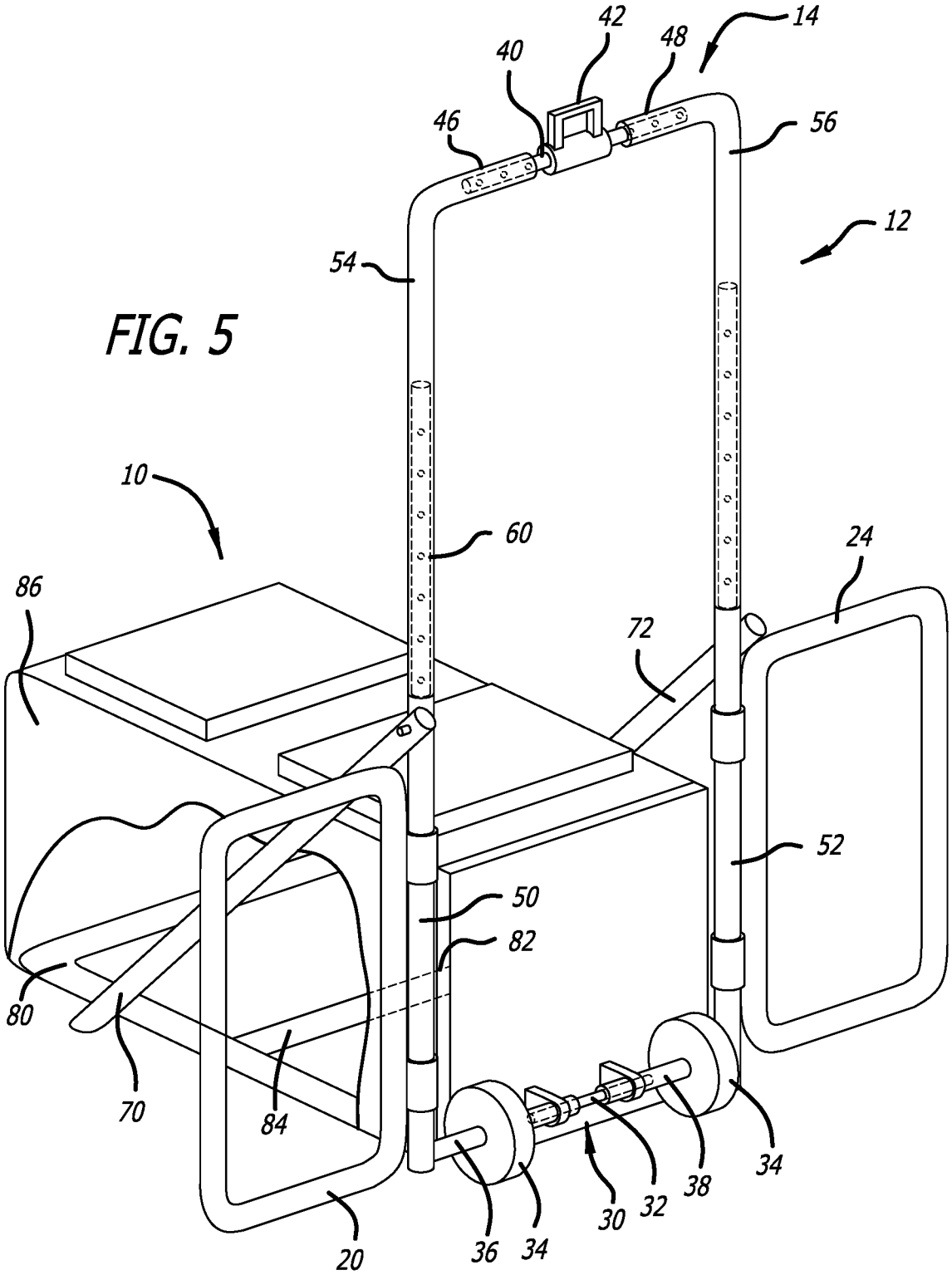
FIG. 5 depicts a detailed further embodiment perspective view of the safety screen assembly and equipment bag of the present invention.
Figure 6:
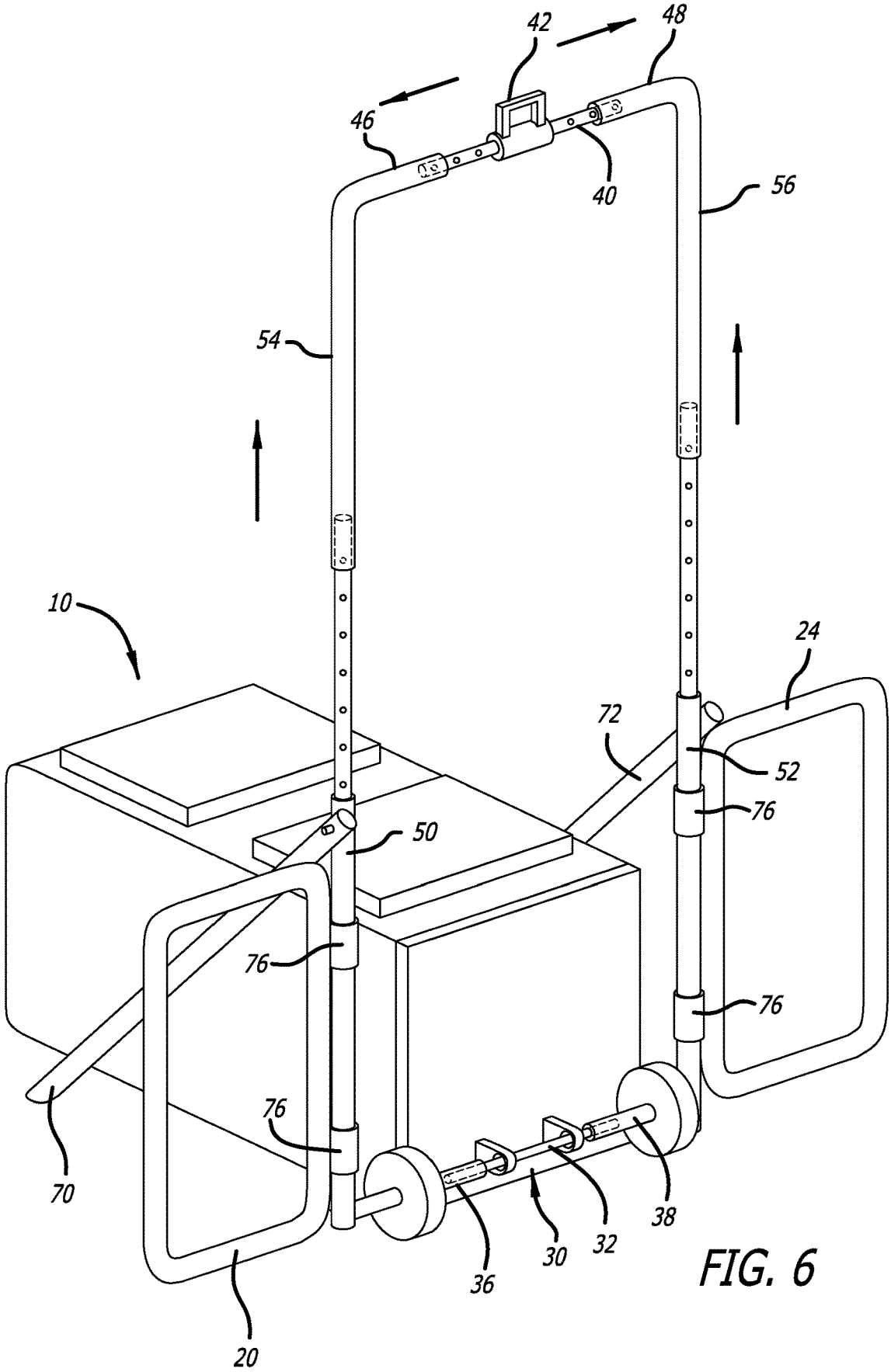
FIG. 6 depicts another perspective view of the safety screen assembly and equipment bag of the present invention.
Figure 7:
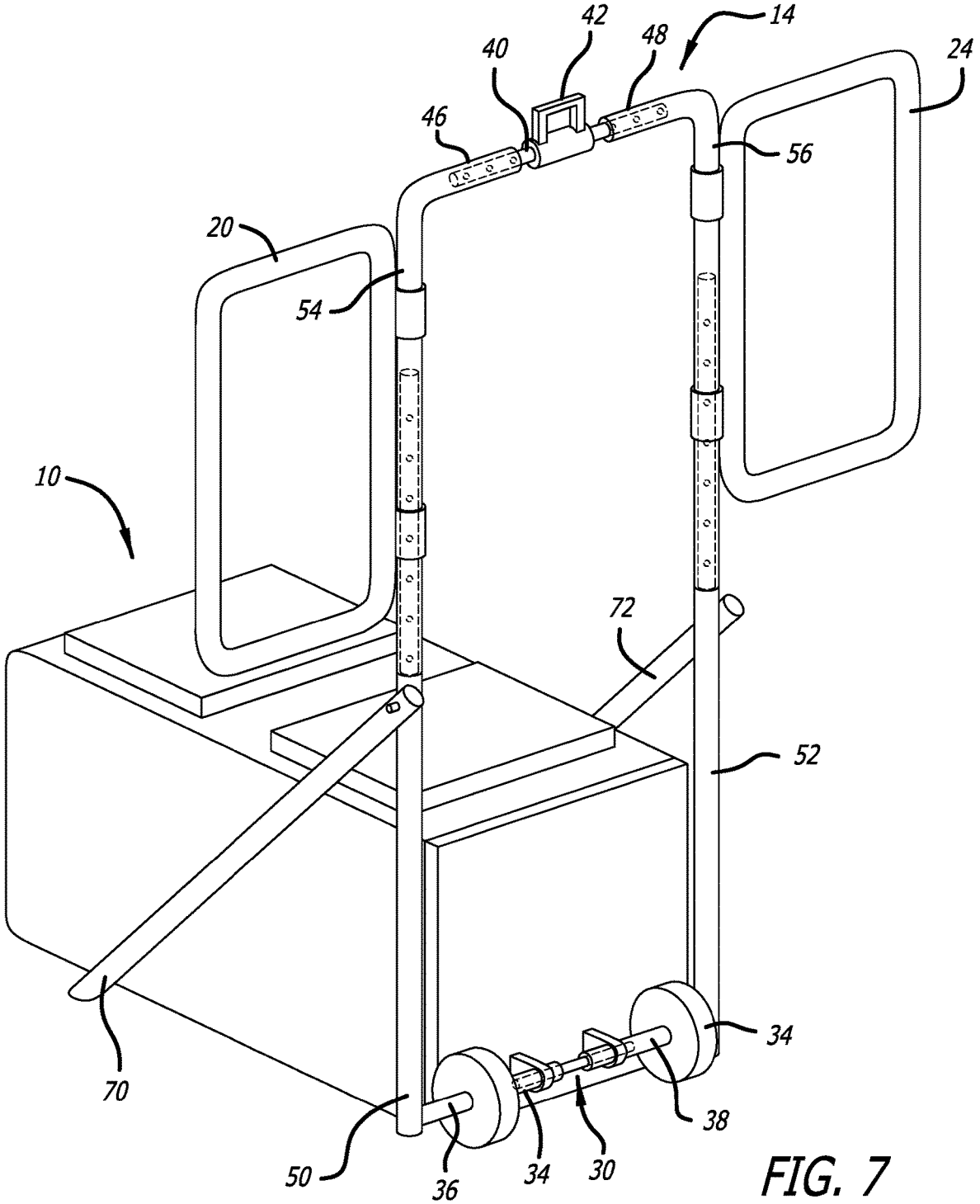
FIG. 7 depicts another perspective view of the safety screen assembly and equipment bag of the present invention.

The main frame 14 preferably includes an axle assembly 30 having an axle 32 and oppositely disposed wheels 34 as depicted in FIGS. 1-3. The axle assembly 30 may optionally include telescoping sleeves 36 and 38 that extend the width of the safety screen assembly 12 as shown in FIGS. 5-7.

The main frame 14 preferably includes a top bar assembly 40 having a handle 42 and a center sleeve 44 secured at its midpoint to the handle 42. The top bar assembly center sleeve 44 may be a solid bar as depicted in FIGS. 1-3, or optionally a hollow sleeve including a pair of telescoping tubes 46 and 48 that extend the width of the top portion of the main frame 14 of the safety screen assembly 12 to match the width of the extended axle assembly 30 as shown in FIGS. 5-7. The top bar assembly and the axle assembly may further include retractable pins (not shown) to secure the telescoping elements.

The main frame 14 includes a right base sleeve 50 and a left base sleeve 52, each of which are attached at their lower ends to the axle assembly 40. The main frame 14 also includes a right top tube 54 sized and configured to telescope from the right base sleeve 50, and a left top tube 56 sized and configured to telescope from the left base sleeve 52. The left and right top tubes 54 and 56 may include resiliently mounted and retractable tabs 58 that allow the left and right top tubes 54 and 56 to be secured within the right and left base sleeves 50, 52 at holes 60 in one or more hole locations along the diameter of the right and left base sleeves 50, 52. The invention contemplates the use of other securement methods, including screws, bolts and rotating attachment methods and the like to position the height of the left and right top tubes 54 and 56 secured to or within the right and left base sleeves 50, 52. As opposed to having telescoping top tubes 54 and 56, the top tubes 54 and 56 may be secured to the base sleeves 50 and 52 with hinges (not shown) allowing the top tubes to pivot from a retracted position laying against the forward side of the base sleeves 50, 52, to an erect position atop the base sleeves 50, 52.

The main frame 14 may include detachable right support 70 and left support 72 that connect to the upper end of the right base sleeve 50 and left base sleeve 52, respectively. The right and left supports 70, 72 may be set at a thirty to forty-five degree angle to the upright main frame 14 to anchor the base sleeves 50 and 52 to the ground on or proximate to the equipment bag 10. The supports 70 and 72 prevent the main frame 14 from collapsing when a ball hits the safety screen assembly 12. The supports 70 and 72 are particularly beneficial when the safety screen assembly 12 is used with an equipment bag 10 that does not incorporate elements to support the safety screen assembly 12.

The frame components of the safety screen assembly 14, other than the main screen 16, wing screens 22 and 26, are preferably formed from aluminum or high strength plastic or composite materials, such as fiber reinforced resin tubes, bars or cylinders, or similar high strength light weight ridged material, and combinations of such materials. The axle may alternatively be formed from steel or similar material. A combination of aluminum and plastic or composite materials may be used. For example, the right and left base sleeves 50 and 52, respectively, may be formed from aluminum, while the right and left top tubes 54 and 56, respectively are formed from plastic or composite materials. While the frame components of the safety screen assembly 14 are depicted as having round cross sections, the frame components may be designed to have oval, square or rectangular cross sections.

Preferably, the equipment bag 10 and the safety screen assembly 12 are designed as an integrated assembly, wherein the equipment bag 10 incorporates a ridged bottom and end frame as depicted in the cutaway view of FIG. 5. The equipment bag 10 of FIG. 5 has a bottom frame 80 and an end frame 82 and may include support elements 84, such as a rod or plate, traversing from the end frame 82 to the bottom frame 80 to fix the respective elements at a right angle to one another. The equipment bag 10 further includes a container 86 preferably formed with a canvas or other fabric material and including pockets and sleeves to accommodate sports equipment such as bats, balls and gloves as well as the main screen 16.

Alternatively, the safety screen assembly 12 may be configured to be attached to a rolling equipment bag, in which case the safety screen assembly 12 may optionally require wheels. The safety screen assembly 12 could be attached with "c" clamps and screws or bolts to a hard or reinforced edge of a rolling equipment bag.

Figure 4:
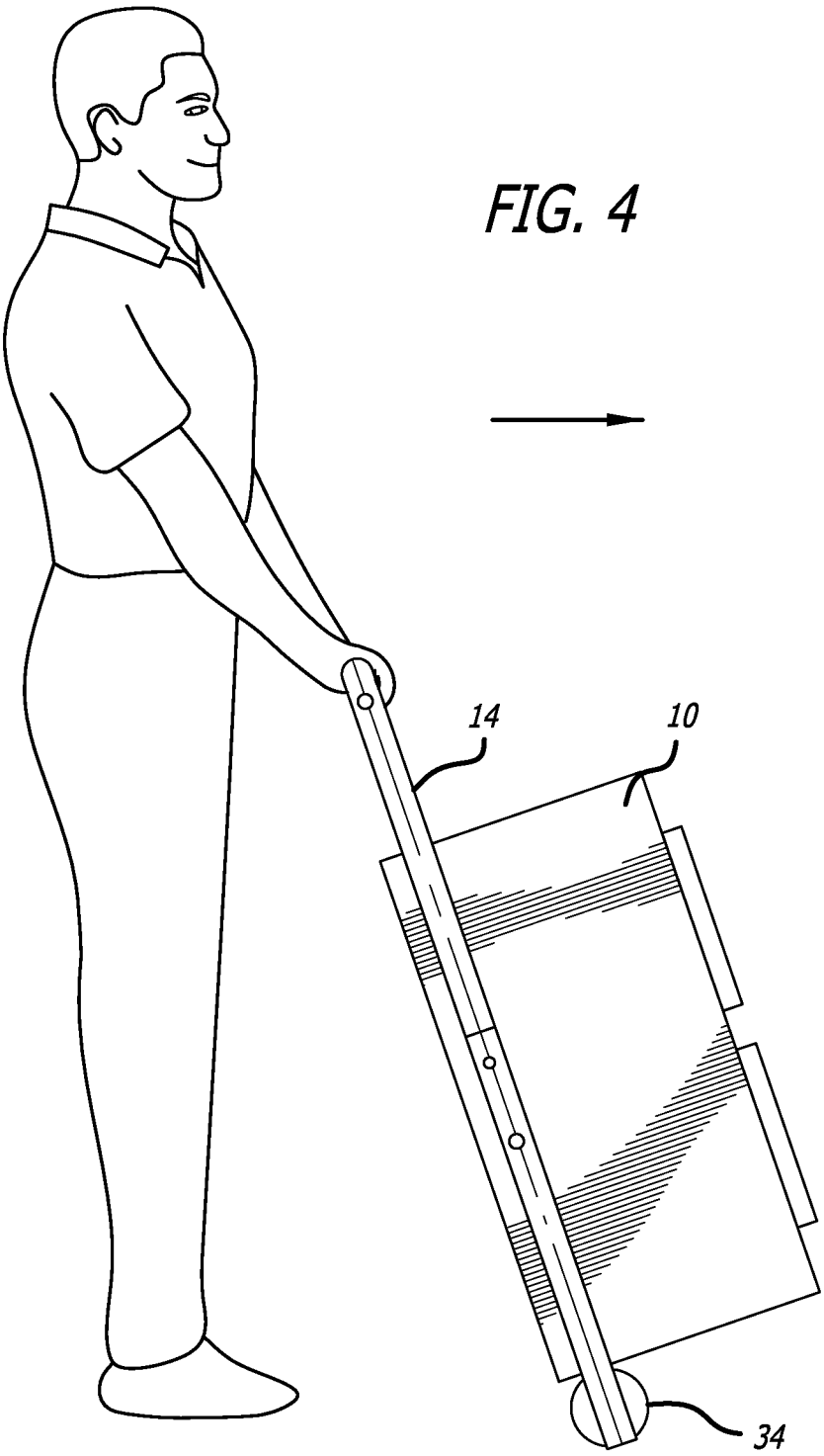
FIG. 4 depicts the equipment bag and stored safety screen assembly with a player.

The equipment bag 10 and safety screen assembly 12 is depicted in the perspective view of FIG. 4 with the safety screen 12 in the stored configuration for transporting the equipment bag 10. In this configuration, the main screen 16 is removed from the main frame 14, and the main frame 14 is locked in a first position to the axle assembly 30, so as to effectively surround the bottom of the equipment bag 10. The optional right and left wing frames 22, 24 may be removed or folded or rotated into the main frame 14, and preferably secured in place to form a support for the bottom of the equipment bag 10. The right top tube 54 and left top tube 56 are retracted into the respective right base sleeve 50 and left base sleeve 52.

When moved into position for a practice session, the right and left wing frames 22, 24 may be placed on the buttons 28 as shown in FIG. 2. Alternatively, the wing frames 22 and 24 may include short cylinders 76 enclosing and slidable of the main frame 14 allowing the wing frames to be placed in variable locations on the main frame 14, as shown in FIGS. 5-7. For assembly of this configuration, the wing frames 22, 24 may be rotated 180 degrees and secured to the outside of the main frame 14. The main frame 14 and the equipment bag 10 are then laid on the ground and the main frame is unlocked from the first orientation on the axle assembly 30, rotated about eighty to ninety degrees over the equipment bag 10 and locked in a second orientation on the axle assembly 30 as depicted in FIG. 1. The right and left top tubes 54 and 56 are then pulled upward, telescoping from the right and left base tubes 50 and 52, and then locked in an extended position by spring biased pins as depicted in FIGS. 5-7. The main screen 16 is then secured to the main frame 14.

In one embodiment, the main screen 16 is formed from a netting material into a pocket shape with one end open so that the netting material may be easily slipped over the main frame 14. The optional right and left supports 70 and 72, may then be attached, or pivoted into position if they are mounted on the main frame 14, to complete the assembly. The weight of the equipment bag 10 provides ballast preventing the safety screen assembly 12 from falling forward while also holding the safety screen assembly 12 upright when it is receives a ball. Once assembled, a pitcher can stand behind or slightly to the side of the equipment bag, deliver a pitch to a batter, and then quickly step behind and be protected by the safety screen assembly 12.

Figure 8:
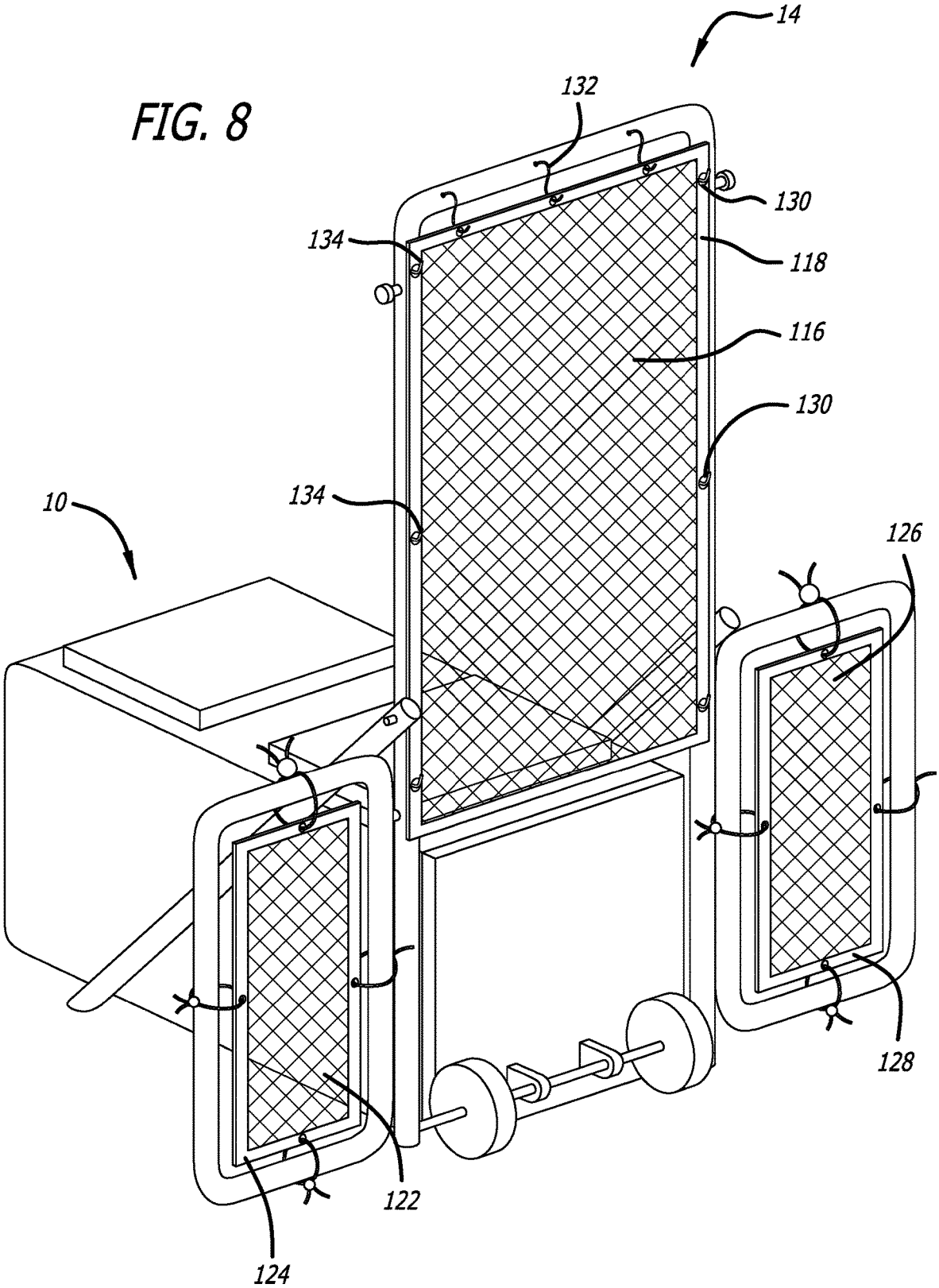
FIG. 8 depicts another perspective view of the safety screen assembly and equipment bag of the present invention.

FIG. 8 depicts alternative configurations of the main screen 116 and wing screens 122, 126. In these configurations, the screens are single layer screens with borders 118, 124 and 128, respectively. The borders may include grommet reinforced holes 130. The grommet reinforced holes 130 may be secured to the main frame 14 with twist-ties or zip-ties as shown on the right and left wings. Alternatively, the screen 116 can be secured with "S" hooks 132 to holes in the main frame 14 as depicted at the top of the main frame 14 of FIG. 8. As another alternative, the holes 130 of the main screen 116 may be secured on hooks or pins 134 on the main frame 14. Other similar or equivalent configurations for securing the main screen 116 to the main frame 14 will be apparent to those skilled in the art.

The safety screen assembly 12 preferably consolidates to a size roughly one and a half to two feet wide and about three feet long, generally matching the size of the base of a standard equipment bag 10. When erected, the safety screen assembly 12 includes the extendable main frame 14 telescopes to length of at least five feet and preferably six and a half to seven feet. The telescoping top bar assembly axle assembly may allow the safety screen assembly 12 to extend to a width of three to six feet.

The invention has been described in detail above in connection with the figures, and it will be understood that various combinations of shapes and configurations for the equipment bag 10 and safety screen assembly 12 are contemplated herein. Those skilled in the art will appreciate that the foregoing disclosure is meant to be exemplary, and the specification and the figures are provided to explain the present invention without intending to limit the potential modes of carrying out the present invention. The scope of the invention is defined only by the appended claims and equivalents thereto.

The invention claimed is:

1. A safety screen assembly providing a rolling carrier for a sports equipment bag, the safety screen assembly comprising:

a main frame having a pair of base sleeves and a pair of top tubes selectively extending the height of the main frame, a top bar connecting the pair of top tubes and an axle assembly connecting the base sleeves;

a main screen formed from a high strength netting material removably attachable to said main frame;

attachment components to secure said main frame to said equipment bag in a first orientation for transporting said equipment bag on said safety screen assembly, and in a second orientation generally perpendicular to the first orientation with said equipment bag providing support for said main frame; and at least one wing screen assembly including a frame and a wing safety screen, said wing screen assembly attachable to at least one position at an upper or lower section of said main frame extending radially outward from said main frame in said second orientation.

2. A safety screen assembly providing a rolling carrier for a sports equipment bag, the safety screen assembly comprising:

a main frame having a pair of base sleeves and a pair of top tubes selectively extending the height of the main frame, a top bar connecting the pair of top tubes and an axle assembly connecting the base sleeves;

a main screen formed from a high strength netting material removably attachable to said main;

attachment components to secure said main frame to said equipment bag in a first orientation for transporting said equipment bag on safety screen assembly and in a second orientation generally perpendicular to the first orientation with said equipment bag providing support for said main frame; and at least one wing screen assembly including a frame and a safety screen, said wing screen assembly attached to said main frame and pivotable between a first position between said base sleeves of said main frame in said first orientation and a second position radially outward from said main frame in said second orientation.

3. The safety screen of claim 1, further comprising:

a pair of supports connectable to said main frame to provide support to said main frame in said second orientation.

4. The safety screen of claim 1, wherein said high strength netting material is a high density polyethylene, high density polypropylene or nylon material twisted and knotted to define one-half to two inch openings.

5. The safety screen of claim 1, wherein said base sleeves are formed from aluminum, high strength plastic or fiber reinforced composite materials and have a cross sectional shape selected from the group including cylindrical, oval, square or rectangle.

6. A sporting equipment bag and safety screen comprising:

an equipment bag having a base, at least one rigid end coupled to said base and a container attached to said base and said rigid end;

a main frame having a pair of base sleeves and a pair of top tubes selectively extending of the main frame height, a top bar connecting the pair of top tubes, and an axle assembly connecting the pair of base sleeves, wherein said axle assembly including a pair of wheels;

a main screen formed from a high strength netting material attachable to said pair of top tubes of said main frame forming a safety screen between said pair of top tubes; and attachment components to secure said main frame to said equipment bag in a first orientation for transporting said equipment bag and said safety screen, and in a second orientation generally perpendicular to the first orientation with said equipment bag providing support for said main frame;

said axle assembly further comprises an axle and a pair of sleeves mounted on said axle, said sleeves telescoping on said axle and supporting said wheels; and said top bar further comprises a center sleeve, an attached handle and a pair of telescoping tubes selectively extending from said center sleeve whereby a width of said safety screen is expandable in said second orientation from one to four times said safety screen width in said first orientation.

* * * * *